US011125035B2

(12) United States Patent
White

(10) Patent No.: US 11,125,035 B2
(45) Date of Patent: Sep. 21, 2021

(54) METHOD AND SYSTEM FOR POSITIONING A MAGNETIC FLUID CONDITIONER

(71) Applicant: FLO-RITE FLUIDS, INC., Clyde, TX (US)

(72) Inventor: John W. White, Clyde, TX (US)

(73) Assignee: Flo-Rite Fluids, Inc., Clyde, TX (US)

( * ) Notice: Subject to any disclaimer, the term of this patent is extended or adjusted under 35 U.S.C. 154(b) by 555 days.

(21) Appl. No.: 15/160,390

(22) Filed: May 20, 2016

(65) Prior Publication Data

US 2016/0340991 A1 Nov. 24, 2016

Related U.S. Application Data

(60) Provisional application No. 62/164,353, filed on May 20, 2015.

(51) Int. Cl.

| | |
|---|---|
| ***E21B 23/01*** | (2006.01) |
| ***E21B 37/00*** | (2006.01) |
| ***E21B 33/12*** | (2006.01) |
| ***E21B 23/02*** | (2006.01) |

(52) U.S. Cl.

CPC ..... *E21B 23/01* (2013.01); *E21B 23/02* (2013.01); *E21B 33/12* (2013.01); *E21B 37/00* (2013.01)

(58) Field of Classification Search

CPC ..... E21B 23/01; E21B 7/067; C02F 1/481

See application file for complete search history.

(56) References Cited

U.S. PATENT DOCUMENTS

| | | | | |
|---|---|---|---|---|
| 2,789,655 A | | 4/1957 | William et al. | |
| 2,792,115 A | | 5/1957 | Medearis | |
| 2,825,464 A | | 3/1958 | Mack | |
| 3,379,257 A | * | 4/1968 | Tamplen | E21B 33/129 166/137 |

(Continued)

FOREIGN PATENT DOCUMENTS

| | | |
|---|---|---|
| GB | 2 132 997 A | 7/1984 |
| SU | 649-441 | 2/1979 |

(Continued)

OTHER PUBLICATIONS

Flo-Rite Fluids, Inc.—advertisement brochure (undated), 5 pages.
Flo-Rite Fluids, Inc.—Magnetic Fluid Conditioners, brochure (undated), 14 pages.

*Primary Examiner* — Robert E Fuller
*Assistant Examiner* — Lamia Quaim
(74) *Attorney, Agent, or Firm* — Foley & Lardner LLP

(57) ABSTRACT

This disclosure presents methods and systems for positioning a magnetic fluid conditioner in a well. One or more magnetic fluid conditioners are attached to a coupling mandrel operable to engage with the tubing of a well, either with an existing completion component or directly with the tubing. The coupling mandrel includes a locking mechanism, such as keys or dogs, for setting the mandrel to the profile nipple. The coupling mandrel further includes a packing stack or an expandable element that seals with the completion component or the tubing. The seal directs oil through the mandrel and thus, through the magnetic fluid conditioners. In some embodiments, multiple magnetic fluid conditioners are attached in tandem for more effective conditioning operations. The magnetic fluid conditioners can condition the oil to inhibit the formation of paraffin therein.

21 Claims, 9 Drawing Sheets

(56) References Cited

U.S. PATENT DOCUMENTS

| | | | | |
|---|---|---|---|---|
| 3,680,705 | A | 8/1972 | Happ et al. | |
| 4,145,208 | A | 3/1979 | Gulko et al. | |
| 4,161,984 | A * | 7/1979 | Watkins | E21B 23/02 166/217 |
| 4,167,480 | A | 9/1979 | Mach | |
| 4,216,092 | A | 8/1980 | Shalhoob et al. | |
| 4,289,621 | A | 9/1981 | O'Meara, Jr. | |
| 4,299,700 | A | 11/1981 | Sanderson | |
| 4,299,701 | A | 11/1981 | Garrett et al. | |
| 4,491,120 | A | 1/1985 | Hodgkins | |
| 4,505,815 | A | 3/1985 | Lindler | |
| 4,532,040 | A | 7/1985 | Meeks et al. | |
| 4,539,102 | A | 9/1985 | Boston et al. | |
| 4,595,054 | A * | 6/1986 | Schroeder | E21B 23/02 166/217 |
| 4,711,271 | A | 12/1987 | Weisenbarger et al. | |
| 4,769,130 | A | 9/1988 | Christensen | |
| 4,935,133 | A | 6/1990 | Hirama | |
| 4,938,875 | A | 7/1990 | Niessen | |
| 4,995,425 | A | 2/1991 | Weisenbarger et al. | |
| 4,999,106 | A | 3/1991 | Schindler | |
| 5,009,791 | A | 4/1991 | Lin et al. | |
| 5,024,271 | A | 6/1991 | Meihua | |
| 5,037,546 | A | 8/1991 | Janczak et al. | |
| 5,043,063 | A | 8/1991 | Latimer | |
| 5,052,491 | A | 10/1991 | Harms et al. | |
| 5,055,190 | A | 10/1991 | Hayes et al. | |
| 5,118,416 | A | 6/1992 | Janczak et al. | |
| 5,122,277 | A | 6/1992 | Jones | |
| 5,178,757 | A | 1/1993 | Corney | |
| 5,269,915 | A | 12/1993 | Clair | |
| 5,366,623 | A | 11/1994 | Clair | |
| 5,453,188 | A | 9/1995 | Florescu et al. | |
| 5,454,943 | A | 10/1995 | Ashton et al. | |
| 5,520,158 | A | 5/1996 | Williamson | |
| 5,660,723 | A | 8/1997 | Sanderson | |
| 5,700,376 | A | 12/1997 | Carpenter | |
| 5,755,970 | A | 5/1998 | Fourqurean et al. | |
| 5,871,642 | A | 2/1999 | Meeks | |
| 5,944,195 | A | 8/1999 | Huang et al. | |
| 6,056,872 | A | 5/2000 | Glass | |
| 6,077,333 | A | 6/2000 | Wolfs | |
| 6,171,504 | B1 | 1/2001 | Patterson | |
| 6,216,527 | B1 | 4/2001 | Beecham et al. | |
| 6,491,825 | B2 | 12/2002 | Kamibayashi et al. | |
| 6,602,411 | B1 | 8/2003 | Aida et al. | |
| 7,350,409 | B2 | 4/2008 | Klatt | |
| 7,357,862 | B2 | 4/2008 | White | |
| 7,572,371 | B2 * | 8/2009 | White | C02F 1/481 166/66.5 |
| 7,591,175 | B2 | 9/2009 | Klatt | |
| 7,665,546 | B2 | 2/2010 | Ruttley | |
| 8,298,428 | B2 | 10/2012 | Hagen | |
| 9,039,901 | B2 | 5/2015 | White | |
| 2002/0084224 | A1 | 7/2002 | Tovar De Pablos et al. | |
| 2005/0056579 | A1 | 3/2005 | Hodgson | |
| 2006/0006106 | A1 | 1/2006 | White | |
| 2006/0131223 | A1 | 6/2006 | Hou et al. | |
| 2007/0108116 | A1 | 5/2007 | Meeks | |
| 2007/0205158 | A1 | 9/2007 | Shanahan et al. | |
| 2010/0270216 | A1 | 10/2010 | Burnett et al. | |
| 2011/0139722 | A1 | 6/2011 | Simonson | |
| 2013/0248172 | A1 * | 9/2013 | Angeles Boza | E21B 43/08 166/250.01 |

FOREIGN PATENT DOCUMENTS

| | | |
|---|---|---|
| WO | 2006/010124 | 1/2006 |
| WO | 2007/001729 | 1/2007 |

* cited by examiner

METHOD AND SYSTEM FOR POSITIONING A MAGNETIC FLUID CONDITIONER

CROSS-REFERENCE TO RELATED APPLICATIONS

This application is a United States Non-Provisional Patent Application which claims the benefit of priority from U.S. Provisional Patent Application No. 62/164,353, filed May 20, 2015.

This disclosure incorporates by reference for all purposes the following US Patents and U.S. patent applications: U.S. Pat. No. 5,871,642, entitled "Magnetic Liquid Conditioner," issued Feb. 16, 1999; U.S. Pat. No. 7,357,862, entitled "Fluid Conditioning System and Method," issued Apr. 15, 2008; U.S. Pat. No. 7,572,371, entitled "Fluid Conditioning System and Method," issued Aug. 11, 2009; U.S. Pat. No. 9,039,901, entitled "Magnetic Water Conditioner," filed May 8, 2008; and U.S. patent application Ser. No. 14/566,658, entitled "Magnetic Metal Extractor From Oil," filed Dec. 10, 2014.

FIELD

This disclosure relates to oil and gas production, and more specifically, to positioning tools in a producing well for conditioning oil to inhibit the formation of paraffin or scale.

BACKGROUND

Several types of fluidized natural resources are extracted from underground formations including, but not limited to, water and hydrocarbons. With the extraction of these resources and the transportation of them (e.g., via pipeline) to a usable location on the surface, an undesirable precipitation of substances can occur within the fluid. For example, calcium carbonate can precipitate to form a scale in water; for another example, paraffin can precipitate in hydrocarbons (namely crude oil). A precipitate may be defined as a substance separating, in solid particles, from a liquid as a result of a chemical or physical change, or as a suspension of small solid particles in a liquid. The term precipitate may also be defined as the act of forming a solid and for the substance that is precipitated out of a solution. Precipitation in a water or oil pipeline, such as in oil well piping, often results in an undesirable deposit buildup on the internal wall of the piping and in storage tanks and other pipeline elements.

The deposit build-up adversely impacts the system. For example, paraffin deposition in crude oil transportation is a major concern in the oil and gas industry. Paraffin deposition could cost the worldwide oil and gas industry billions of dollars each year. This includes a variety of costs, such as, for example, inhibition and remediation costs, reduced or deferred production, well shut-ins, pipeline replacements and/or abandonment, equipment failures, extra horsepower requirements due to clogged systems, and increased manpower needs for various operational concerns. Known methods combine the negative effects of paraffin scraping and chemicals treatment and are often ineffective and cost prohibitive. Each of these processes, however, is not only expensive, but can also require extensive amounts of manpower and production downtime. In the case of chemicals, environmental and safety concerns are introduced due to inherent risks involved with handling the chemicals. Further, chemicals can reduce the capability to remove undesirable water and other substances from crude oil.

SUMMARY

This disclosure presents methods and systems for positioning a magnetic fluid conditioner in a well. In some embodiments, one or more magnetic fluid conditioners are attached to a coupling mandrel operable to engage with existing completion components in the well, such as a profile nipple. The profile nipple has a locking profile and a seal area. The coupling mandrel includes a locking mechanism, such as keys or dogs, for setting the mandrel to the profile nipple. The coupling mandrel further includes a packing stack that seals with the profile nipple at the seal area, for directing oil through the mandrel and thus, through the magnetic fluid conditioners. In some embodiments, multiple magnetic fluid conditioners are attached in tandem for more effective conditioning operations. The magnetic fluid conditioners can condition the oil to inhibit paraffin from forming therein.

In another instance, a profile nipple is not necessary for deploying the magnetic fluid conditioners. For example, a mandrel with expandable teeth on the side walls may engage the internal walls of the well's tubing once placed at desired positions (such as anywhere above the completion component). The mandrel may also include an expander for sealing the passage between the outer wall of the mandrel and the inner wall of the tubing to direct oil to flow through the mandrel and the magnetic fluid conditioners attached thereto. This embodiment allows for more flexible positioning of the magnetic fluid conditioners, and multiple mandrels may be deployed in the same well.

In a first general aspect, a method for positioning a magnetic fluid conditioner in a tubing of a producing well is described. The tubing has a completion component including a section of tubular wall with an internal surface machined to provide a seal area and a locking profile. The method includes inserting a coupling mandrel into the well. The coupling mandrel is connected to the magnetic fluid conditioner at a distal end of the coupling mandrel. The coupling mandrel is positioned partially within the completion component. The coupling mandrel is locked at the locking profile of the completion component. The coupling mandrel is sealed using the seal area of the completion component. As a result, the fluids are directed to flow through the coupling mandrel and the magnetic fluid conditioner.

In some embodiments, locking the coupling mandrel to the locking profile includes expanding a set of locking keys of the coupling mandrel to engage the locking profile of the completion component.

In some other embodiments, positioning the coupling mandrel further includes attaching a slick line (wire line), an E line, or a coil tubing to a fishing neck of a proximal end of the coupling mandrel.

In yet some other embodiments, sealing the coupling mandrel using the seal area includes placing a packing stack in contact with the seal area, wherein the seal area is honed and polished to receive the packing stack.

In some embodiments, the completion component is a profile nipple placed at a strategic position of the well to allow accurate placement of the magnetic fluid conditioner.

In some other embodiments, directing fluids to flow through the coupling mandrel and the magnetic fluid conditioner attached thereto further includes conditioning the fluids to inhibit the formation of paraffin.

In yet some other embodiments, locking the coupling mandrel to the locking profile includes engaging the locking profile via a spring loaded locking dog on the coupling mandrel when the locking dog travels into the locking profile.

In a second general aspect, a method for positioning a magnetic fluid conditioner in a well includes inserting and positioning a mandrel into a tubing of the well. The mandrel is connected to the magnetic fluid conditioner at a distal end of the mandrel. A number of teeth of the mandrel is expanded to engage internal walls of the tubing when the mandrel is at a desired position in the tubing. The mandrel is sealed and set with respect to the internal walls of the tubing using an expander of the mandrel. Fluids are then directed to flow through the coupling mandrel and the magnetic fluid conditioner.

In some embodiments, expanding the number of teeth of the mandrel further includes pulling up a distal portion of the mandrel to displace a plurality of slips surrounding the distal portion as to expand the slips and the plurality of teeth thereon to bite against the internal walls of the tubing.

In some other embodiments, the mandrel is coupled to more than one magnetic fluid conditioner in tandem.

In yet some other embodiments, directing fluids to flow through the coupling mandrel and the magnetic fluid conditioner attached thereto further includes conditioning the fluids to inhibit the formation of paraffin.

In some embodiments, the desired position in the tubing is a position above a profile nipple positioned inside the tubing.

In some other embodiments, lowering the mandrel into the tubing includes attaching a slick line (wire line), an E line, or a coil tubing onto a fishing neck of the mandrel.

In a third general aspect, a system for positioning a magnetic fluid conditioner in a well includes a tubing installed with at least one completion component at a first location. The completion component includes at least a section of tubular wall with an internal surface machined to provide a seal area and a locking profile. A coupling mandrel is configured to be connected to the magnetic fluid conditioner at a distal end of the coupling mandrel. The coupling mandrel is configured to be locked at the locking profile of the completion component. The coupling mandrel is configured to be sealed against the seal area of the completion component to direct fluids to flow through the coupling mandrel and the magnetic fluid conditioner.

In some embodiments, the coupling mandrel includes a set of locking keys expandable to engage the locking profile of the completion component.

In some other embodiments, the coupling mandrel is attached to a slick line (wire line), an E line, or a coil tubing at a fishing neck of a proximal end of the coupling mandrel.

In yet some other embodiments, the coupling mandrel further includes a packing stack for sealing with the seal area wherein the seal area is honed and polished to receive the packing stack.

In some embodiments, the completion component is a profile nipple installed at the first location of the tubing to allow accurate placement of the magnetic fluid conditioner.

In some other embodiments, the magnetic fluid conditioner is configured to condition the fluids to inhibit the formation of paraffin.

In yet some other embodiments, the coupling mandrel includes a spring loaded locking dog for engaging the locking profile when the locking dog travels into the locking profile.

In some embodiments, the magnetic fluid conditioner further includes a first end, a second end, and a number of singularly alternating opposing magnetic transitions separated by spacers. The magnetic fluid conditioner is operable to receive the flowing fluid at the first end, to provide a magnetic field to the flowing fluid, and to discharge the flowing fluid at the second end. The magnetic fluid conditioner further includes a sleeve having a first end, a second end, an internal surface area, an external surface area, and an internal volume of the sleeve defined by the boundaries of the first end, the second end and the internal surface area of the sleeve. The magnetic fluid conditioner further includes a cylindrical member having a first end, a second end, an internal surface area, an external surface area, and a hollow internal volume of the cylindrical member defined by the boundaries of the first end, the second end and the internal surface area of the cylindrical member.

The magnetic fluid conditioner further includes a first number of magnets stacked together with the spacers in between in a magnetic attraction orientation to hold the stacked magnets together to form a first stack of magnets; and a second plurality of magnets stacked together with the spacers in between in a magnetic attraction orientation to hold the stacked magnets together to form a second stack of magnets. The first stack of magnets are positioned along a first portion of the external surface of the cylindrical member, and the second stack of magnets are positioned along a second portion of the external surface of the cylindrical member such that a magnetic attraction is cylindrical member such that a magnetic attraction is established between the first stack of magnets and the second stack of magnets through the hollow internal volume of the cylindrical member to apply a magnetic flux density to the hollow internal volume, and to hold the first stack of magnets along the first portion of the external surface of the cylindrical member, and to hold the second stack of magnets along the second portion of the external surface of the cylindrical member. The cylindrical member, the first stack of magnets and the second stack of magnets are positioned in the internal volume of the sleeve, and the hollow internal volume of the cylindrical member serves as the flow path for flowing fluid to flow from the first end of the cylindrical member to the second end of the cylindrical member.

BRIEF DESCRIPTION OF THE DRAWINGS

For a more complete understanding of various embodiments of the present invention and the advantages thereof, reference is now made to the following brief description, taken in connection with the accompanying drawings, appendices, and detailed description, wherein like reference numerals represent like parts, and in which.

DETAILED DESCRIPTION

In the following detailed description and the attached drawings and appendices, numerous specific details are set forth to provide a thorough understanding of the present disclosure. However, those skilled in the art will appreciate that the present disclosure may be practiced, in some instances, different from such specific details. In other instances, well-known elements have been illustrated in schematic or block diagram form in order not to obscure the present disclosure in unnecessary detail. Additionally, for the most part, specific details, and the like, have been omitted inasmuch as such details are not considered necessary to obtain a complete understanding of the present disclosure, and are considered to be within the understanding of persons of ordinary skill in the relevant art.

This disclosure describes methods and systems for positioning a magnetic fluid conditioner in the well. The methods and systems allow for accurate positioning and setting of the magnetic fluid conditioners such that oil flows through the magnetic fluid conditioners and becomes conditioned via magnetic transitions to inhibit the formation of paraffin and scale. Multiple embodiments are disclosed.

In a first embodiment, an existing completion component is used. A profile nipple placed at strategic positions in the well for receiving tools can be used for receiving the coupling mandrel that carries one or more magnetic fluid conditioners down the well. The coupling mandrel can lock and seal with the profile nipple and directs the oil to flow through the mandrel and the magnetic fluid conditioner attached thereto.

In a second embodiment, a slip lock mandrel can be set with respect to the tubing and seal to direct oil to flow through the mandrel. In this embodiment, no profile nipple is needed so that the slip lock mandrel may be placed anywhere in the tubing, such as, for example, above the completion component.

Figure 1:
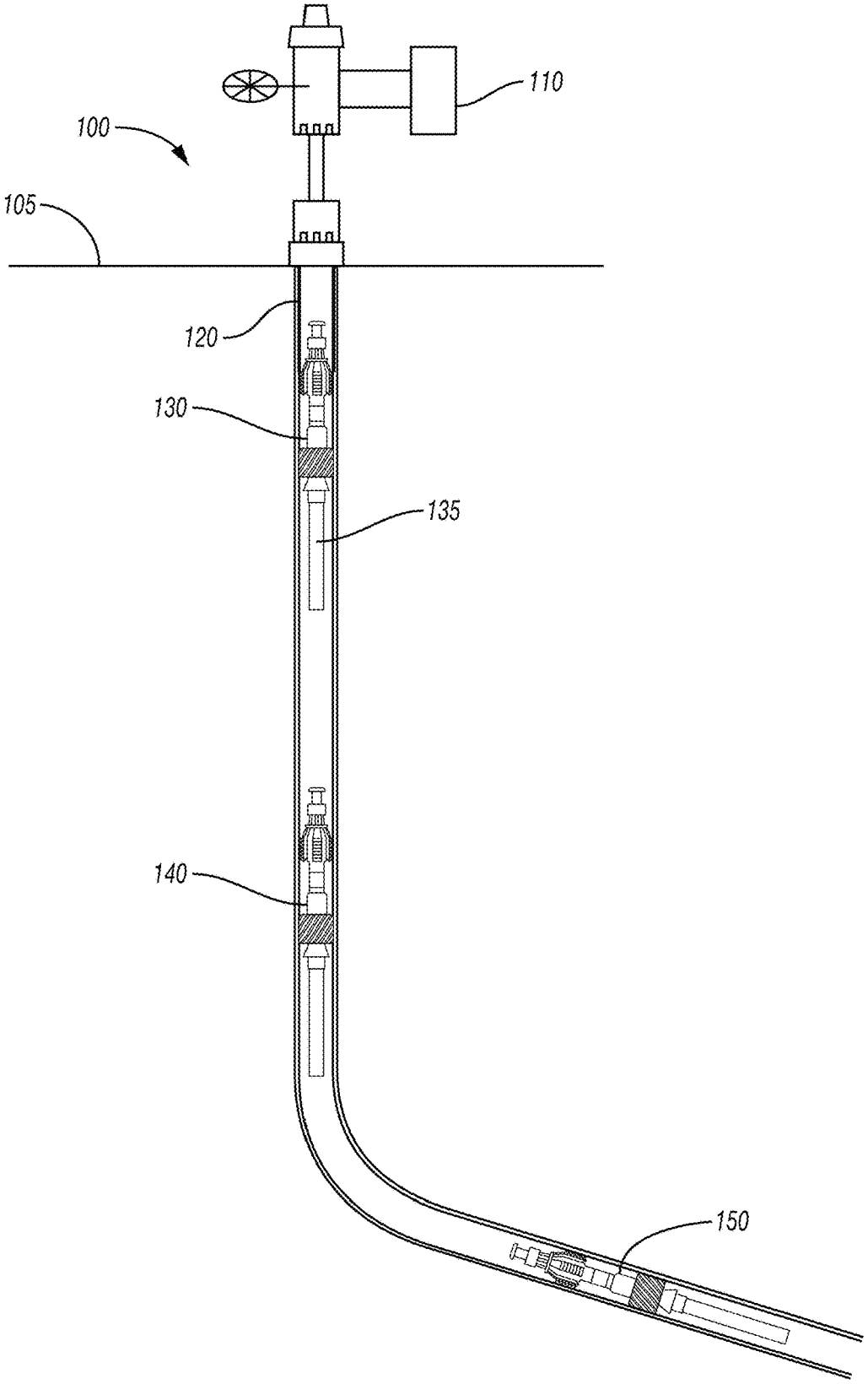
FIG. 1 illustrates a schematic view of a well.

FIG. 1 illustrates a schematic view of a well 100. The well 100 includes a wellhead 110 and the tubing 120 under the ground surface 105. One or more mandrels 130, 140, 150 are placed inside the tubing 120. Each mandrel may carry a magnetic fluid conditioner, such as the magnetic fluid conditioner 135 attached at the distal end of the mandrel 130. In some embodiments, the mandrels 130, 140, and 150 may be placed inside tubing 120 at locations corresponding to a profile nipple or other completion component placed at strategic positions inside the well 100. In other instances, there may be one completion component placed near the end of the tubing 120, and one or more of the mandrels 130, 140, and 150 placed above the completion component.

Figure 2:
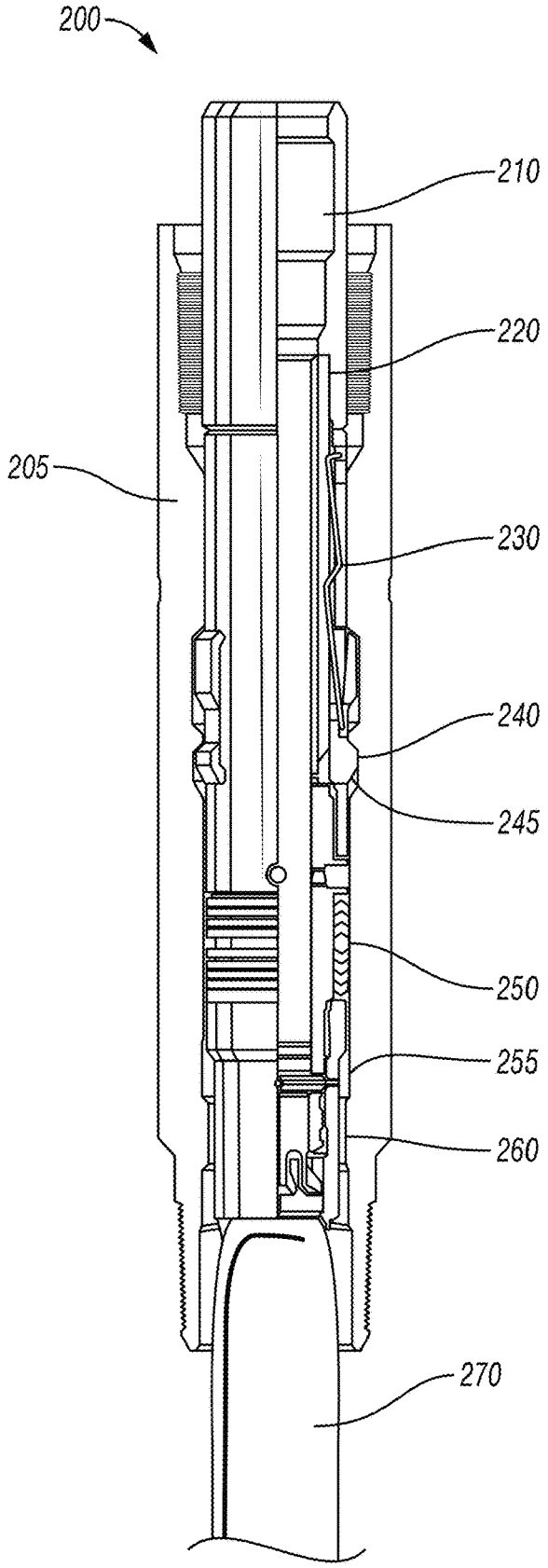
FIG. 2 illustrates a cross-sectional view of a completion component coupled with a coupling mandrel with a magnetic fluid conditioner, showing a half side view and a half cross-sectional side view.

FIG. 2 illustrates a cross-sectional view of a completion component 205 coupled with a coupling mandrel 200 with a magnetic fluid conditioner 270. In this embodiment, the completion component 205 is a profile nipple. The profile nipple may be installed in the tubing string with a packer below it to seal off the casing and force fluid run through the nipple. The coupling mandrel 200 is deployed and retrieved using its fishing neck 210 with a slick line or a coil tubing (not shown). The coupling mandrel 200 includes an expander mandrel 220, double-acting spring 230, and a plurality of locking keys 240. The completion component 205 includes a short section of strong tubular wall with an internal surface machined to provide a seal area 255 and the locking profile 245. The coupling mandrel 200 locks the keys 240 into the locking profile 245 to engage with the completion component 205. The packing 250 of the coupling mandrel 200 seals off the completion component 205. The coupling mandrel 200 further includes a no-go equalizing sub 260 and the magnetic fluid conditioner 270 attached onto the no-go equalizing sub 260.

During operation, the completion component 205 is first placed at a strategic position into the well 100. The coupling mandrel 200 is then inserted into the well 100, carrying the magnetic fluid conditioner 270 at the distal end. When the coupling mandrel 200 is lowered to the completion component 205, the keys 240 are pushed outward radially to engage the locking profile 245 of the completion component 205. The packing 250 seals the sealed area 255 and therefore directs the fluids in the well to flow through the magnetic fluid conditioner 270 and the coupling mandrel 200. Although FIG. 2 illustrates a particular type of completion component, such as a profile nipple, and a specific type of coupling mandrel 200, any other different types of profile nipple or coupling mandrel having the capability of locking and sealing may be used in a similar fashion. For example, an alternative configuration of the coupling mandrel is illustrated in FIG. 3.

Figure 3:
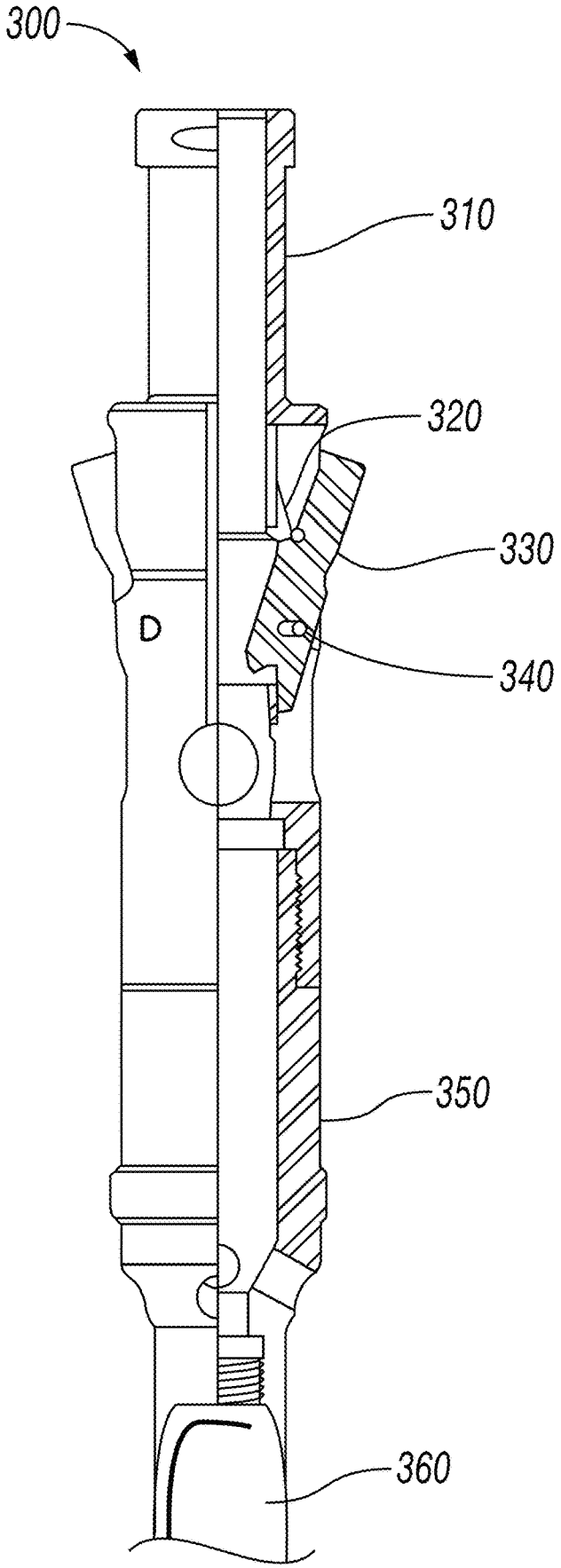
FIG. 3 illustrates an embodiment of a coupling mandrel, showing a half side view and a half cross-sectional side view.

FIG. 3 illustrates an embodiment of a coupling mandrel 300. The coupling mandrel 300 includes a fishing neck 310, dog springs 320, locking dogs 330, dog pins 340, and a bottom adapter 350. The dog springs 320 exerts a bias force to move the locking dogs 330 outward radially, rotating with respect to the dog pins 340. As the locking dogs 330 passes the locking profile 245 of the completion component 205, the locking dogs 330 will engage the locking profile 245 to secure the coupling mandrel 300 in place with respect to the completion component 205. One or more magnetic fluid conditioners 360 may be attached at the distal end of the bottom adapter 350. The bottom adapter 350 may be configured to seal with the completion component 205 to direct oil to flow through the coupling mandrel 300 and the one or more magnetic fluid conditioners 360.

Other coupling mandrels may also be used in the place of the coupling mandrel 300. For example, the mandrel may not be limited to the specified components and can further include a fishing neck, a no-go retainer, a shear pin, a no-go ring, one or more sheer dogs, an expander tube, a lock housing, a backup ring, a packing stack, and adapter ring, a packing body, a ratchet assembly, and other components for specific mandrel configurations.

Figure 4:
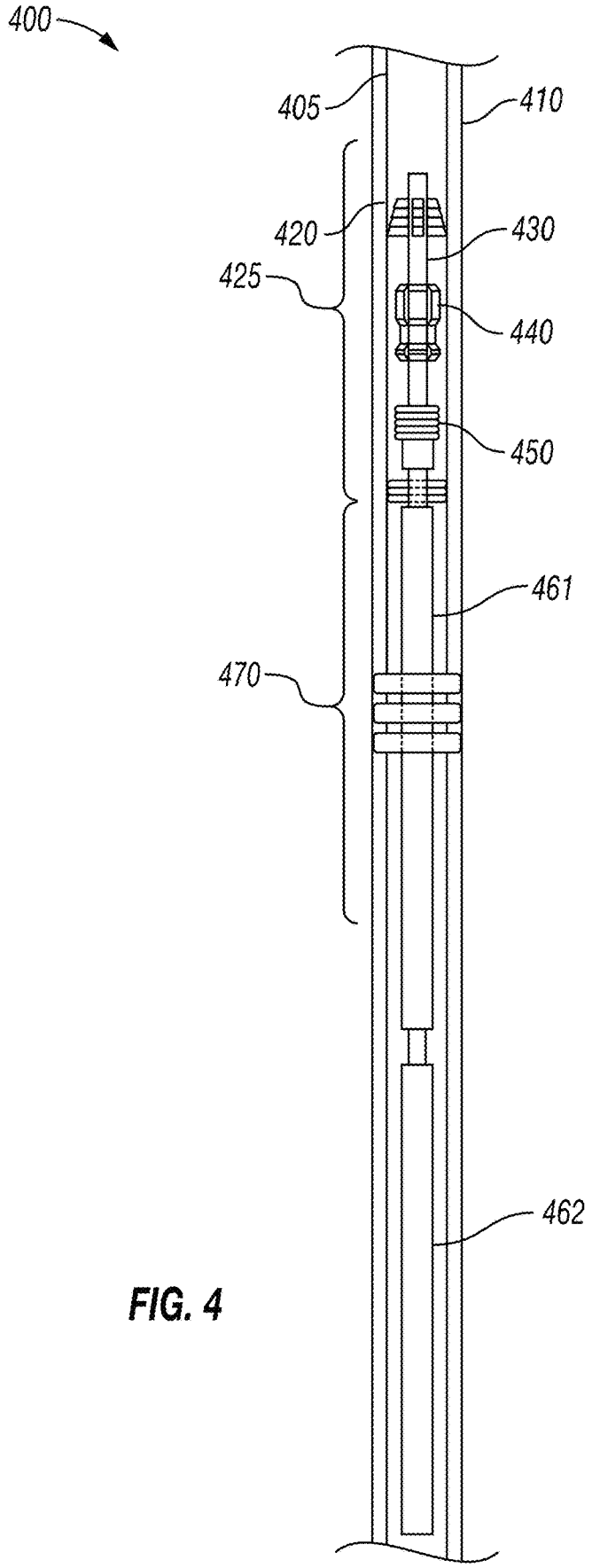
FIG. 4 illustrates a schematic side view of more than one magnetic fluid conditioners in tandem.

FIG. 4 illustrates a schematic view 400 of multiple magnetic fluid conditioners 461 and 462 in tandem. The schematic view 400 includes a tubing 405 and the casing 410. A profile nipple 420 is placed inside the tubing 405. A coupling mandrel 425 is inserted into the tubing 405 and the profile nipple 420, carrying the magnetic fluid conditioners 461 and 462. The coupling mandrel 425 includes a lock mandrel 430, dogs 440, and packing 450. The dogs 440 latches into the profile nipple 420 to set the coupling mandrel 425 in place. The packing 450 seals off the profile nipple 420. A packer 470 is installed below the profile nipple 420 and seals off the casing 410. The magnetic fluid conditioners 461 at 462 are connected in tandem and operate in series to condition the oil. Although only two magnetic fluid conditioners 461 and 462 are illustrated, three or more magnetic fluid conditioners may be used. Examples for the magnetic fluid conditioner 461 or 462 are further provided in FIGS. 8A-8B.

Figure 5:
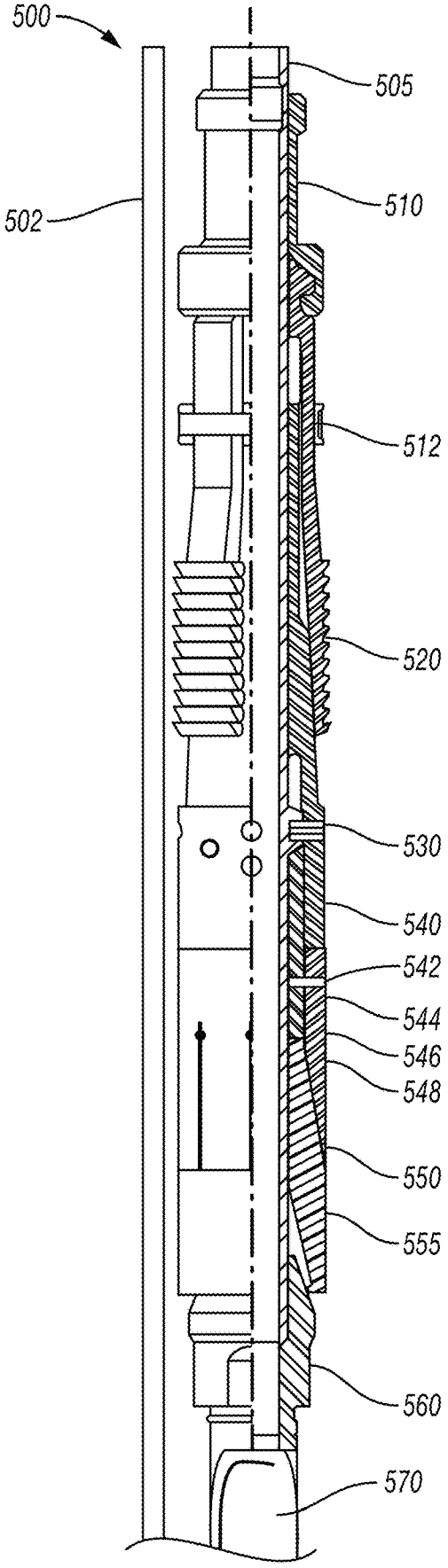
FIG. 5 illustrates a slip lock mandrel, showing a half side view and a half cross-sectional side view.

FIG. 5 illustrates a cross sectional side view 500 of a slip lock mandrel 505. In this embodiment, the slip lock mandrel 505 may be used without a completion component, such as the profile nipple 420, and directly engages the tubing 502. The slip lock mandrel 505 includes a slip carrier 510, a band 512, a plurality of slip teeth 520, one or more sheer pins 530, and a slip mandrel 540. The slip mandrel 540 further includes a roll pin 542, an 0 ring 544, a pins sub 546, and a sleeve 548. There is an inner sleeve 550 and an element 555. And expander 560 is at the distal end of the mandrel 505. One or more magnetic fluid conditioners 570 are attached at the expander 560.

During operation, the slip lock mandrel 505 is lowered into the well, and when it is at the desired depth, the expander 560 is pulled up so that the plurality of slip teeth 520 of force to expand radially to bite into place in the tubing 502. The expander 560 also increased the radial dimension of the element 555 to seal off the tubing 502. Such slip lock mandrel 505 allows for positioning the magnetic fluid conditioners 570 at any location of the tubing 502, above a completion component such as the profile nipple and packer. Similar to previous illustrations, although only one magnetic fluid conditioner 570 is illustrated; two or more can be carried by the slip lock mandrel 505 in tandem.

Figure 6:
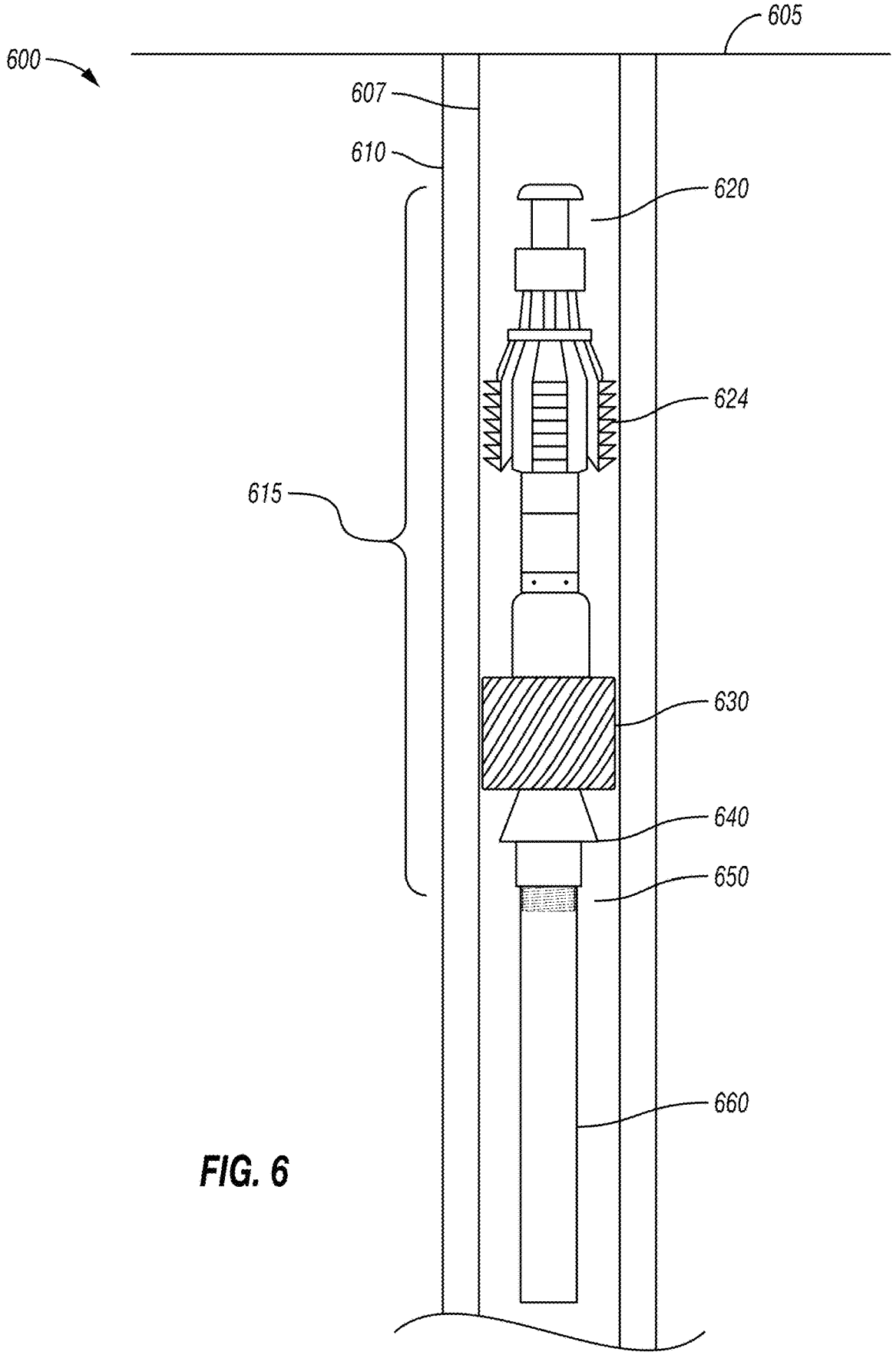
FIG. 6 illustrates a schematic side view of a well having a slip lock mandrel set in the tubing with a magnetic fluid conditioner.

FIG. 6 illustrates a schematic side view 600 of a well 610 under the ground surface 605. The well 610 has a slip lock mandrel 615 set in the tubing 607 with a magnetic fluid conditioner 660. The slip lock mandrel 615 includes a fishing neck 620, a plurality of slips 624, a packing element 630, and an expander 640. The magnetic fluid conditioners 660 is connected at a threaded bottom 650 of the distal end of the slip lock mandrel 615. During operation, the fishing neck 620 is connected to a slick line (wire line), an E line, or a coil tubing for deployment and retrieval. Once the slip lock mandrel 615 is lowered to the desired depth (e.g., anywhere in the tubing 607 above a profile nipple), the expander 640 is pulled up to expand the plurality of slips 624 and the packing element 630. The plurality of slips 624 sink into the tubing 607 to hold the mandrel 615 in place. And the packing element 630 is expanded to seal off the casing of the well 610. The seal in effect directs the oil to flow through the magnetic fluid conditioner 660 and the mandrel 615. As the oil flows through the magnetic fluid conditioners 660, the conditioners 660 act to condition the oil to inhibit paraffin from forming therein.

Figure 7:
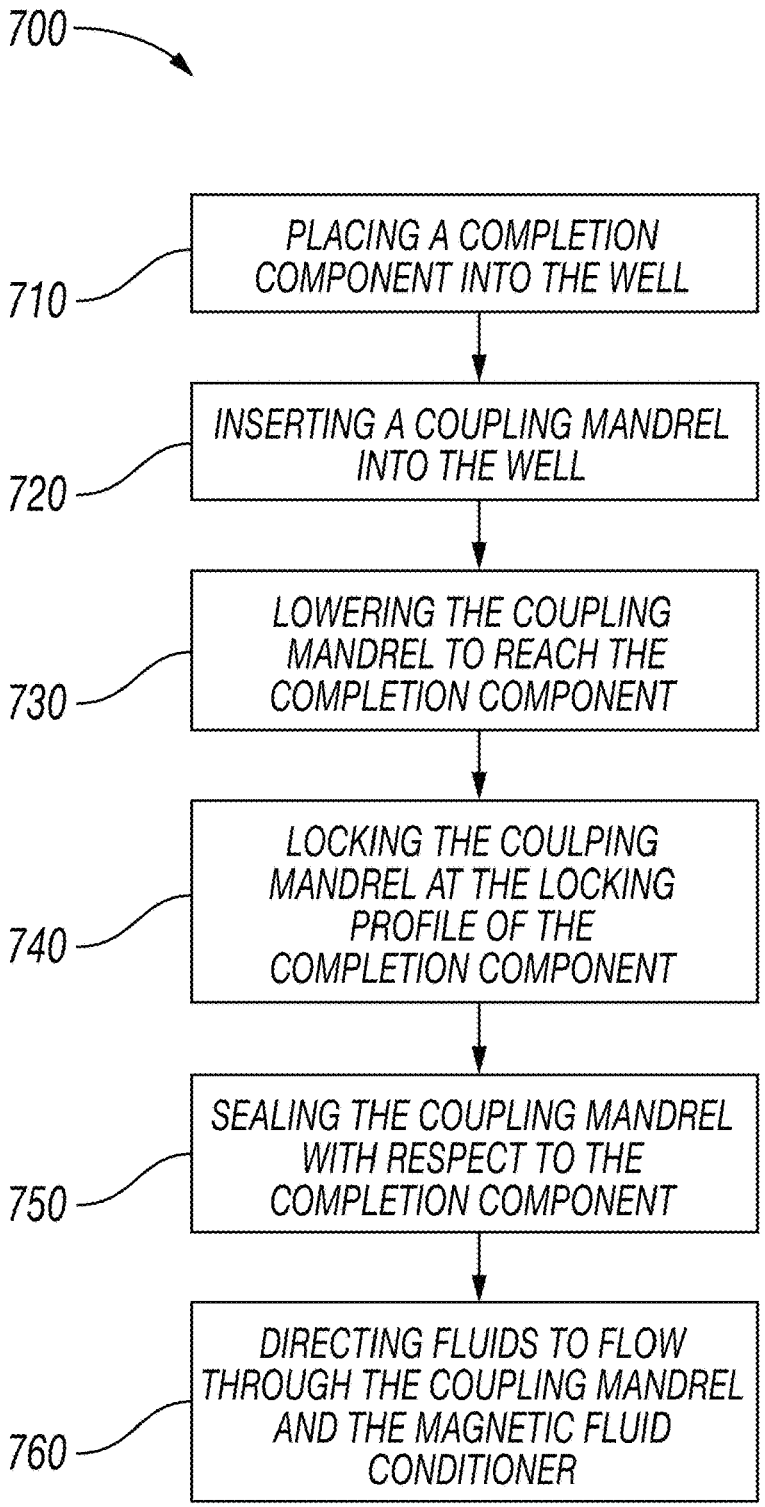
FIG. 7 is an example flow chart for the method of placing one or more magnetic fluid conditioners.

FIG. 7 is an example flow chart 700 for the method of placing one or more magnetic fluid conditioners in a producing well having a completion component installed therein. The flow chart 700 corresponds to the positioning systems described in FIGS. 2-4, wherein a completion component, such as a profile nipple, is used. The completion component may include a short section of strong tubular wall with an internal surface machined to provide a seal area and a locking profile. For example the completion component can be a profile nipple that enables the installation of flow-control devices, such as plugs and chokes.

At 720, a coupling mandrel is inserted into the well. The coupling mandrel carries the magnetic fluid conditioner at its distal end. In some embodiments, two or more magnetic fluid conditioners may be assembled in tandem and carried together with the coupling mandrel. At 730, the coupling mandrel is lowered to reach the completion component. For example, a slick line (wire line), an E line, or a coil tubing is attached to the proximal end of the coupling mandrel at the fishing neck.

At 740, when the coupling mandrel has reached the completion component, the coupling mandrel is deadlocked at a locking profile of the completion component. For example, the coupling mandrel includes a set of locking keys that can be expanded by pulling an expander upwards, wherein the expanded locking keys engage the locking profile of the completion component. In other instances, locking the coupling mandrel at the locking profile includes spring loading a locking dog on the coupling mandrel for engaging the locking profile when a locking dog travels into the locking profile. The locking dog then inhibits the coupling mandrel from moving upwards in the retrieval direction.

At 750, the coupling mandrel is sealed with respect to the completion component. For example, a packing stack of the coupling mandrel is mated with the sealed area of the completion component, wherein the seal area is honed and polished to receive the packing stack. In some embodiments, the completion component is a profile nipple placed at a strategic position of the well to allow accurate placement of the magnetic fluid conditioner.

At 760 the oil is directed to flow through the coupling mandrel and the magnetic fluid conditioner after the space between the coupling mandrel and the completion component has been sealed off. The magnetic fluid conditioner includes a plurality of magnetic transitions that condition the oil to inhibit paraffin from forming (further described in FIGS. 8A-8G).

Although the flowcharts 700 illustrate a method for positioning a magnetic fluid conditioner in the well with a completion component, such as a profile nipple, the completion component is not always necessary. For example, in a different embodiment, a slip lock mandrel may be used to set the magnetic fluid conditioner in the tubing of the well without engaging a completion component. As such, the slick level mandrel is first inserted and lowered into the tubing of the well (e.g., with a slick line (wire line), an E line, or a coil tubing holding onto the fishing neck of the mandrel), such as illustrated in FIGS. 5-6.

The slick level mandrel carries the magnetic fluid conditioner at its distal end. Upon reaching at the desired position of the well, a plurality of teeth of the mandrel is expanded to engage the internal walls of the tubing. The mandrel is then sealed and set with respect to the internal walls of the tubing with an expander of the mandrel. For example, the expander displaces and expands a plurality of teeth and an element, such that the teeth sink and engage with the internal wall surfaces of the tubing to secure the mandrel in place while the element expands to seal off the space between the mandrel and the tubing. The oil is then directed to flow through the mandrel and the magnetic fluid conditioner attached thereto.

Either the embodiment illustrated in the flow chart 700 or the alternative example without use of a completion component may have one or more mandrels, each carrying one or more magnetic fluid conditioners. One of ordinary skill in the art may adapt and modify the described embodiments to specific operation requirements based on the disclosed methods and systems. Therefore, the above description is not limited to the explicit embodiment presented herein.

Figure 8B:
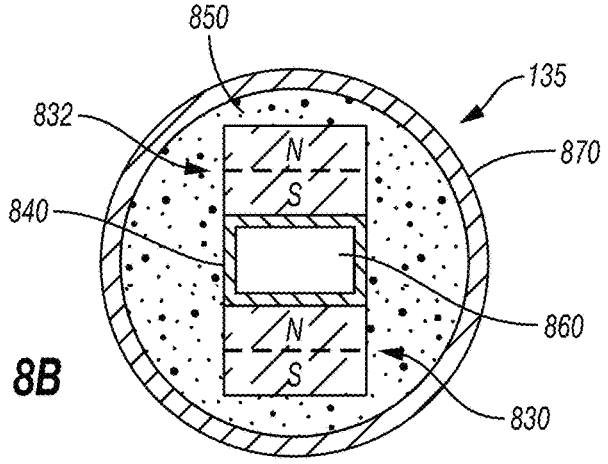
FIGS. 8A-8G illustrate various examples of the magnetic fluid conditioner applicable to previous embodiments.
Figure 8A:
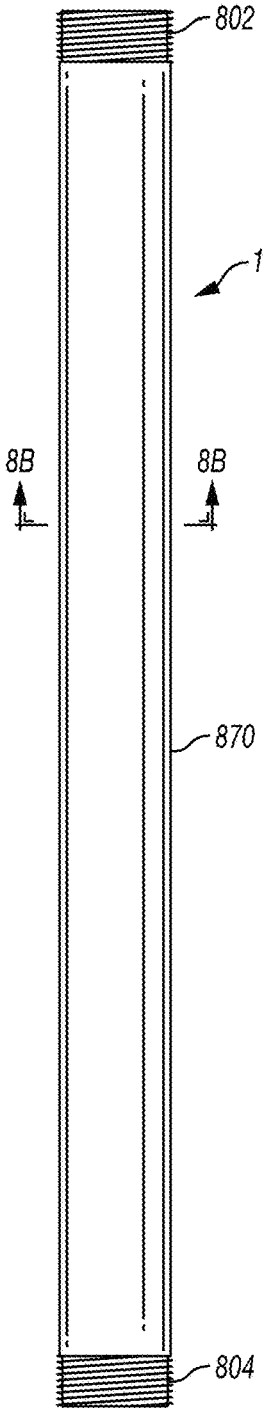
Figure 8C:
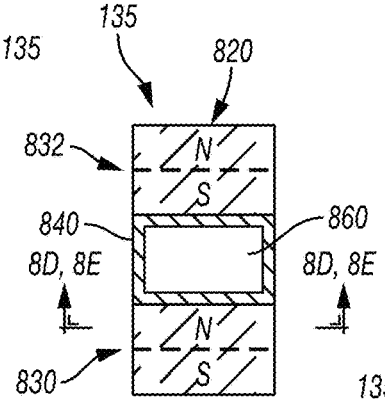
Figure 8D:
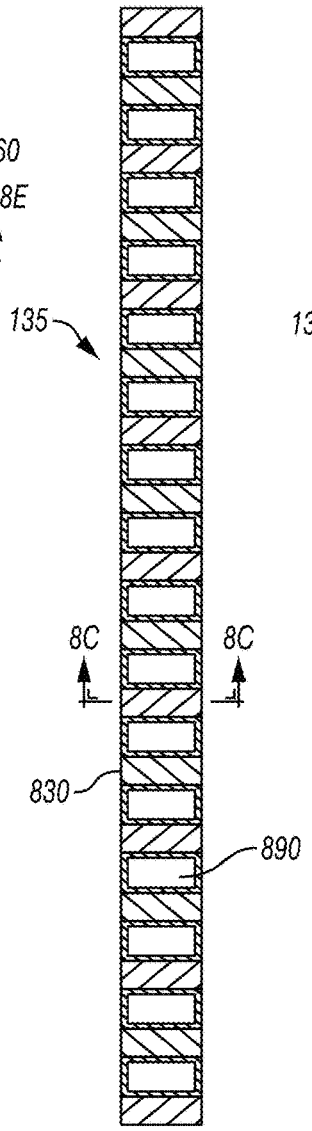
Figure 8E:
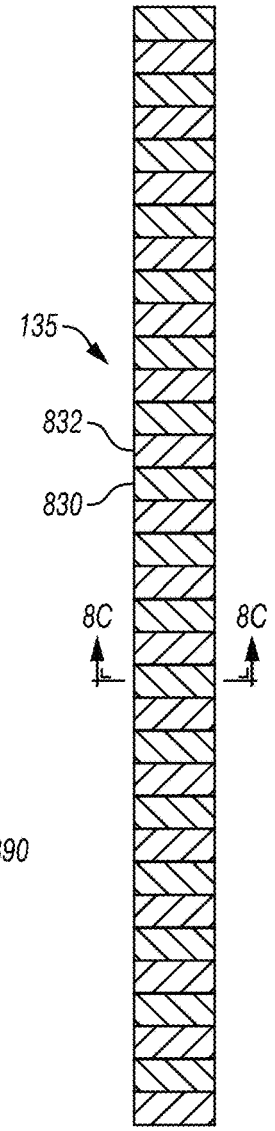

FIGS. 8A-8E illustrate various examples of the magnetic fluid conditioner 135. Detailed specification and configuration of the magnetic fluid conditioner 135 is fully incorporated by reference to the U.S. Pat. No. 7,572,371 and restated herein. FIG. 8A is a side view, FIG. 8B is a cross sectional end view, FIG. 8C is a detailed isolated end view with side cross sections defined, FIG. 8D is a first example of a side cross sectional view, and FIG. 8E is a second example of a side cross sectional view.

FIG. 8A shows an external side view of the magnetic fluid conditioner 135. The magnetic fluid conditioner 135 is arranged as a pup joined pipe 870 (e.g., to be threadedly connected with the coupling mandrel 200 or the slip lock mandrel 500). The pup joined pipe 870 serves as an outer casing, housing or sleeve in which the assembly of either FIG. 8D or 8E can be inserted. A thread collar 802 may be provided at the first end of the magnetic fluid conditioner 135 and another thread collar 804 may be provided at the second end of the magnetic fluid conditioner 135. Such threading can allow the magnetic fluid conditioner 135 to be attached to well tubing, in-line, and lowered to the bottom of the well, while provided above ground and connected to a piping as desired. In one embodiment, the pup joined pipe 870 may be implemented using stainless steel mechanism mechanical tubing with an outer diameter of 1.66 inches or larger.

Figure 8F:
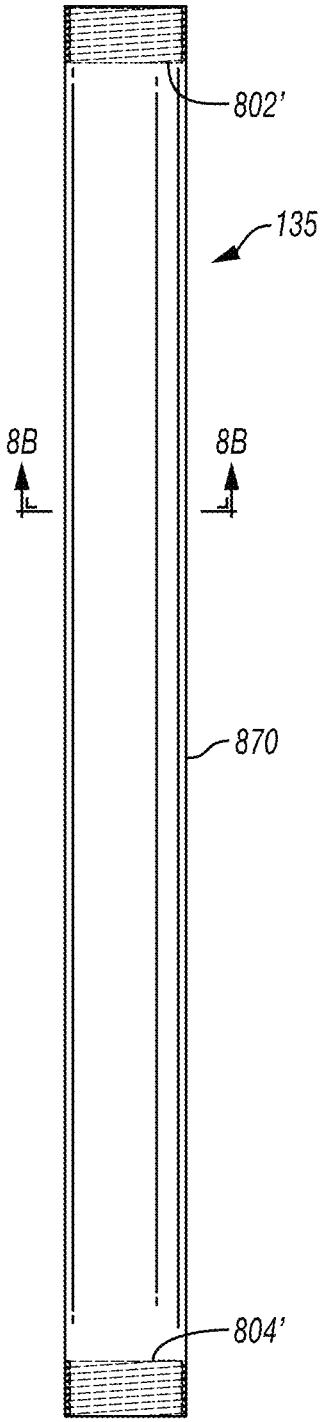

Although FIG. 8A illustrates the thread collars 802 and 804 being male threads, other embodiments are possible. For example, as illustrated in FIG. 8F, the thread collars 802' and 804' are both female threads. In other embodiments yet illustrated, the pup joined pipe 870 may have male threads at one end and female threads at the other end. When multiple magnetic fluid conditioners 135 are joined in tandem, additional connector may be used. For example, for the male threads type of thread collars 802 and 804 of FIG. 8A, a female-female threads connector may be used to connect two pieces of the pup joined pipes 870 together. Alternatively, for the female threads type of thread collars 802' and 804' of FIG. 8F, a male-male threads connector can be used. Other connector variations are possible when different thread types are used.

FIG. 8B is an end, cross-sectional view of the magnetic fluid conditioner 135, which includes magnets 830 and 832 disposed around, or on opposite sides of, the rectangular tubing 840, along with any positive filler 850 mounted or positioned around the magnets 830 and 832, and a stainless rectangular tubing 840, and inside of the pipe 870. In some embodiments, the positive filler 850 may be a cured resin, epoxy, or other suitable material (such as silicone rubber) to exclude moisture or water from the rectangular tubing 840. The cross sectional area of the channel 860 in the center of the magnetic fluid conditioner 135 may be the same cross-sectional area as to the tubing, or smaller. The circular cross-sectional configuration of the pup joined pipe 870 allows the magnetic fluid conditioner 135 to fit easily within a circular wellbore. It should be recognized by one of ordinary skill in the art that the size and configuration described with reference to the configuration of the magnetic fluid conditioner 135 of FIGS. 8C, 8D and 8E can vary depending on the particular application in which the magnetic fluid conditioner 135 will be utilized.

The magnetic fluid conditioners provide the capability to expose a fluid, such as oil or water, to multiple pole reversals or magnetic transitions, i.e., fluid flows through magnetic fields set up in opposite or different directions, over a short distance. This may include the fluid flowing through three or more magnetic transitions or magnetic pole reversals of at least about 1700 Gauss over a one foot length of a magnetic fluid conditioner. In another embodiment, the fluid flowing through eleven or more magnetic transitions (also referred to as magnetic pole reversals) with a magnetic flux density in the center of the flow path of at least about 1700 Gauss, as the fluid flows along a foot length of a magnet fluid conditioner. This is believed to greatly enhance the effectiveness of the magnetic fluid conditioner 135.

The stainless steel rectangular tubing 840 generally defines a channel 860, which may be referred to as the flow path or flow region of the rectangular tubing 840, through which fluid will flow. Preferably the stainless steel rectangular tubing 840 is made of an alloy that will not (or minimally) effect the magnetic field generated by the magnet 840 and 832—e.g., stainless steel, but may be made of any of a variety of available materials and shapes, such as circular, triangular, square, etc. shapes. As an example of size, intended for illustrative purposes only, the stainless steel rectangular tubing 840 can be half an inch by one-and-half an inch and the magnets 830 and 832 may be half an inch by half an inch by one inch, with the half an inch by one inch side serving as the "working face" or "working surface" of the magnet, which is the face closest to the side of the rectangular tubing 840.

FIG. 8C is an end, cross-sectional view of the magnetic fluid conditioner 135 for illustrating the details of FIG. 8B and to help define the side cross sectional views shown in FIGS. 8D and 8E.

Turning now to FIG. 8D, which is a cross-sectional side view of the magnetic fluid conditioner 135, without an external housing or sleeve being shown, taken along lines 8D, 8E-8D, 8E of FIG. 8C, an array or stack of magnets 830 are illustrated. Each magnet 830 is separated by a spacer 890 and positioned in an alternating orientation as illustrated. The spacer 890 is preferably provided as a plastic spacer, and extending from a first end, and the top of the page, to a second end, and the bottom of the page. The magnets 830 are arranged in a row or stack fashion such that the two stacks of magnets are positioned on opposite sides of the rectangular tubing 840 (as shown in FIG. 8B).

The working surface of the magnets are oriented such that at least one North and one South pole of the magnets 830 are positioned opposite each other across the flow region of the rectangular tubing 840 to provide a magnetic flux density of at least 1700 Gauss in the center of the flow region. The magnets 830 may be separated from the magnet above and/or below each other using a spacer 890 as shown. The orientation of the poles of each magnet is preferably arranged such that there is a magnetic attraction between the magnets that are stacked above and below each other in the stack of magnets. This adds additional stability to the stack of magnets, even though the spacer 890 in certain embodiments may comprise of a different thickness, number, or material. In an alternative embodiment, a glue or adhesive may be used between the magnet 830 and a spacer 890 to provide additional structural support to the stack of magnets 830.

The magnets 830 are preferably implemented using rare earth magnets, with a magnetic flux (or field) density sufficient to provide a magnetic flux density in the fluid flow path of, for example, at least about 1700 Gauss, but preferably as high as possible. In a preferred embodiment, the magnetic flux density in the fluid flow path above ground may be provided at about 3500 to 4000 Gauss. In other embodiments, the magnetic flux density is provided in a range between about 1700 Gauss and 5500 Gauss, and a range between about 2800 Gauss and 3000 Gauss for magnetic fluid conditioner positioned downhole. In some embodiments, a high level of magnetic flux density up to about 6000-7000 Gauss may be achieved. It should be understood that a wide range of magnetic flux density can be specified according to various applications, for example, the magnets 830 may be selected or produced to provide a range of about 100-8000 Gauss.

In one preferred embodiment, the materials used for the magnet is neodymium iron boron, which preferably is provided in a water resistant housing, and may include a nickel plating (such as $1/5000^{th}$ of an inch thick coating), or other types of coating as desired. The use of the plurality of magnets 830 helps to maximize the exposure of the fluid flowing through the flow path 860 to numerous magnetic field transitions (which include polarity changes of the magnetic field) generated by the magnets 830.

As an example of the size, intended for illustrative purposes only, the length of the magnetic the fluid conditioner 135 can be 4 to 8 feet long from the first end to the second end. In a preferred embodiment, the number of magnetic field transitions experienced by fluid flowing from the first end to the second end will be a least three magnetic field transitions per foot, and preferably at least eleven magnetic field transitions per foot. In certain embodiments, at least 30 magnetic field transitions per foot may be provided, especially in applications such as downhole oil well applications where space is limited.

FIG. 8E is an alternative cross-sectional side view of the magnetic fluid conditioner 135, without an external housing or sleeve shown, taken along lines 8D, 8E-8D, 8E of FIG. 8C. FIG. 8E shows an array or stack of magnets 830. Compared to the example of FIG. 8D, the fluid conditioner illustrated in FIG. 8E does not include the spacer 890 between each magnet. The orientation of the stack of magnets is as discussed above in connection with FIG. 8D and provides additional magnetic field transitions or field reversals, which is believed to significantly improve the performance of the magnetic fluid conditioner 135. Although example embodiments are provided in FIGS. 8D and 8E, other configuration of the magnets 830 and 832 are possible, as further described and incorporated herein from the U.S. Pat. No. 7,572,371.

Figure 8G:
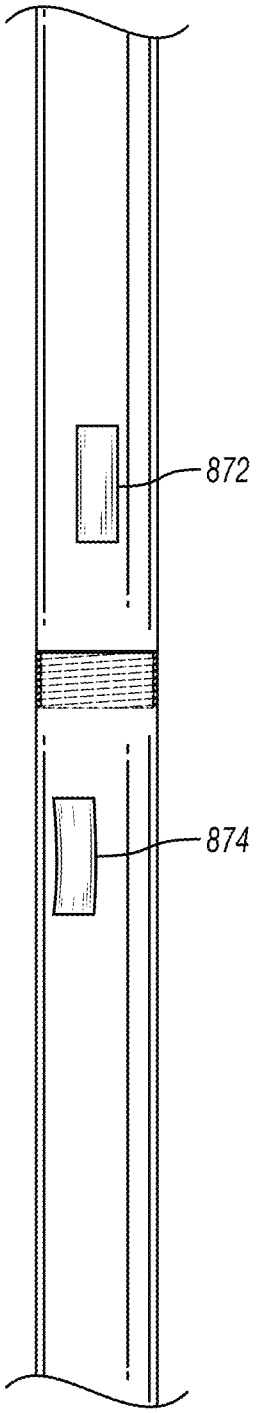

FIG. 8G illustrates two magnetic fluid conditioners 135 assembled in tandem for deployment. Sunk keys 872 and 874 are used to apply sufficient torque to the two pieces of magnetic fluid conditioners to properly seal one off another. In the example illustrated, the connection may be made using a male-male connector when both magnetic fluid conditioners 135 have female thread collars as shown in FIG. 8F. Alternatively, if the magnetic fluid conditioners 135 have male threads at one end, and female threads at the other end, no additional connectors may be necessary for the tandem assembly. Yet in another example, if the magnetic fluid conditioners 135 have both male thread collars 802 and 804 as in FIG. 8A, then an additional female-female connector may be used to form such assembly.

What is claimed is:

1. A method for positioning a magnetic fluid conditioner in a tubing positioned within a casing of a producing well, the tubing having a completion component comprising at least a section of tubular wall with an internal surface to provide a seal area, the method comprising:

inserting a coupling mandrel into the tubing positioned within the casing of the well along a longitudinal direction of the tubing, wherein the magnetic fluid conditioner is connected at a distal end of the coupling mandrel;

positioning the coupling mandrel at least partially within the completion component, wherein the magnetic fluid conditioner is suspended in a volume of the tubing such that the magnetic fluid conditioner is not in contact with the tubing, wherein the completion component of the tubing interfaces at least partially with the coupling mandrel to position the magnetic fluid conditioner suspended in the volume of the tubing such that the magnetic fluid conditioner is not in contact with the tubing;

sealing the coupling mandrel using the seal area of the completion component, wherein the magnetic fluid conditioner is below the seal area and remains in place when tools above the coupling mandrel are actuated or adjusted;

directing fluids to flow through the magnetic fluid conditioner and the coupling mandrel along the longitudinal direction of the tubing such that the fluid cannot flow through the tubing past the seal area without going through the magnetic fluid conditioner;

conditioning the fluids when the fluids travel through the magnetic fluid conditioner in the longitudinal direction of the tubing; and retrieving the coupling mandrel connected to the magnetic fluid conditioner through the tubing, wherein the coupling mandrel connected to the magnetic fluid conditioner is retrieved at a location adjacent a proximal end of the coupling mandrel.

2. The method of claim 1, further comprising locking the coupling mandrel at a locking profile of the completion component, wherein locking the coupling mandrel to the locking profile comprises expanding a set of locking keys of the coupling mandrel to engage the locking profile of the completion component.

3. The method of claim 1, wherein positioning the coupling mandrel further comprises attaching a slick line (wire line), an E line, or a coil tubing to a fishing neck of the proximal end of the coupling mandrel.

4. The method of claim 1, wherein sealing the coupling mandrel using the seal area comprises placing a packing stack in contact with the seal area, wherein the seal area provides a sealable smoothness to receive the packing stack.

5. The method of claim 1, wherein the completion component is a profile nipple placed at a desired position of the well to allow accurate placement of the magnetic fluid conditioner.

6. The method of claim 1, wherein directing fluids to flow through the magnetic fluid conditioner for conditioning the fluids and the coupling mandrel further comprises conditioning the fluids to inhibit the formation of paraffin.

7. The method of claim 2, wherein locking the coupling mandrel to the locking profile comprises engaging the locking profile via a spring loaded locking dog on the coupling mandrel when the locking dog is adjacent the locking profile.

8. A method for positioning a magnetic fluid conditioner in a tubing positioned within a casing of a well, the method comprising:

inserting a mandrel into the tubing positioned within the casing of the well along a longitudinal direction of the tubing, wherein the mandrel and the magnetic fluid conditioner are in fluid communication, and the magnetic fluid conditioner is below a distal end of the mandrel;

positioning the mandrel with the magnetic fluid conditioner such that the mandrel is at least partially radially inward of at least a portion of a profile nipple of the tubing;

positioning the mandrel with the magnetic fluid conditioner below the distal end of the mandrel further into the tubing of the well, wherein the magnetic fluid conditioner is suspended in a volume of the tubing by the mandrel that is at least partially radially inward of at least the portion of the profile nipple of the tubing, such that the magnetic fluid conditioner is not in contact with the tubing;

expanding a plurality of locking members of the mandrel to engage internal walls of the tubing when the mandrel is at a desired position in the tubing;

sealing and setting the mandrel with respect to the internal walls of the tubing;

directing fluids in the tubing below the mandrel in the well to flow through the magnetic fluid conditioner in the longitudinal direction of the tubing to be conditioned before entering the mandrel; and retrieving the mandrel connected to the magnetic fluid conditioner through the tubing, wherein the mandrel connected to the magnetic fluid conditioner is retrieved at a location adjacent a proximal end of the mandrel.

9. The method of claim 8, wherein expanding the plurality of locking members of the mandrel further comprises pulling up a distal portion of the mandrel to displace a plurality of slips surrounding the distal portion as to expand the slips and the plurality of locking members thereon to bite against the internal walls of the tubing.

10. The method of claim 8, wherein the mandrel is coupled to more than one magnetic fluid conditioners that are coupled in tandem.

11. The method of claim 8, wherein fluids directed to flow through the magnetic fluid conditioner and the coupling mandrel further comprises conditioning the fluids to inhibit the formation of paraffin.

12. The method of claim 8, wherein the desired position of the mandrel in the tubing is provided using the profile nipple positioned inside the tubing.

13. The method of claim 8, wherein inserting the mandrel into the tubing of the well comprises lowering the mandrel into the tubing using a slick line (wire line), an E line, or a coil tubing onto a fishing neck of the mandrel.

14. A system for positioning a magnetic fluid conditioner in a tubing positioned within a casing of a well, the system comprising:

a tubing having a longitudinal direction installed with at least one completion component at a first location, the completion component comprising at least a section of tubular wall with an internal surface that provides a seal area and a locking profile;

a coupling mandrel configured to be connected to the magnetic fluid conditioner, the magnetic fluid conditioner in fluid communication with the coupling mandrel at a distal end of the coupling mandrel and below the coupling mandrel, wherein the coupling mandrel is configured to be locked at the locking profile of the completion component, the completion component configured to position the magnetic fluid conditioner;

wherein the coupling mandrel is configured to be sealed against the seal area of the completion component of the tubing and is configured to direct fluids to flow through the magnetic fluid conditioner in the longitudinal direction for magnetic conditioning of the fluids before entering the coupling mandrel; and a proximal end of the coupling mandrel configured to facilitate retrieving the coupling mandrel connected to the magnetic fluid conditioner through the tubing.

15. The system of claim 14, wherein the coupling mandrel comprises a set of locking keys expandable to engage the locking profile of the completion component.

16. The system of claim 14, wherein the coupling mandrel is attached to a slick line (wire line), an E line, or a coil tubing at a fishing neck of the proximal end of the coupling mandrel.

17. The system of claim 14, wherein the coupling mandrel further comprises a packing stack for sealing with the seal area wherein the seal area provides a sealable smoothness to receive the packing stack.

18. The system of claim 14, wherein the completion component is a profile nipple installed at the first location of the tubing to allow placement of the magnetic fluid conditioner.

19. The system of claim 14, wherein the magnetic fluid conditioner is configured to condition the fluids to inhibit the formation of paraffin.

20. The system of claim 14, wherein the coupling mandrel comprises a spring loaded locking dog for engaging the locking profile when the locking dog travels into the locking profile.

21. The system of claim 14, wherein the magnetic fluid conditioner further comprises:

a first end;

a second end;

a plurality of singularly alternating opposing magnetic transitions separated by spacers, the magnetic fluid conditioner operable to receive the flowing fluid at the first end, to provide a magnetic field to the flowing fluid, and to discharge the flowing fluid at the second end;

a sleeve having a first end, a second end, an internal surface area, an external surface area, and an internal volume of the sleeve defined by the boundaries of the first end, the second end and the internal surface area of the sleeve;

a cylindrical member having a first end, a second end, an internal surface area, an external surface area, and a hollow internal volume of the cylindrical member defined by the boundaries of the first end, the second end and the internal surface area of the cylindrical member;

a first plurality of magnets stacked together with the spacers in between in a magnetic attraction orientation to hold the stacked magnets together to form a first stack of magnets;

a second plurality of magnets stacked together with the spacers in between in a magnetic attraction orientation to hold the stacked magnets together to form a second stack of magnets;

wherein the first stack of magnets are positioned along a first portion of the external surface of the cylindrical member, and the second stack of magnets are positioned along a second portion of the external surface of the cylindrical member such that a magnetic attraction is established between the first stack of magnets and the second stack of magnets through the hollow internal volume of the cylindrical member to apply a magnetic flux density to the hollow internal volume, and to hold the first stack of magnets along the first portion of the external surface of the cylindrical member, and to hold the second stack of magnets along the second portion of the external surface of the cylindrical member; and wherein the cylindrical member, the first stack of magnets and the second stack of magnets are positioned in the internal volume of the sleeve, and the hollow internal volume of the cylindrical member serves as the flow path for flowing fluid to flow from the first end of the cylindrical member to the second end of the cylindrical member.

* * * * *